US012662833B2

(12) United States Patent
Dickson

(10) Patent No.: US 12,662,833 B2
(45) Date of Patent: Jun. 23, 2026

(54) SYSTEM AND METHOD FOR POOL EQUIPMENT PROTECTION

(71) Applicant: David Dickson, Cumming, GA (US)

(72) Inventor: David Dickson, Cumming, GA (US)

(73) Assignee: DDI Inc., Cumming, GA (US)

( * ) Notice: Subject to any disclaimer, the term of this patent is extended or adjusted under 35 U.S.C. 154(b) by 219 days.

(21) Appl. No.: 18/535,758

(22) Filed: Dec. 11, 2023

(65) Prior Publication Data

US 2024/0191530 A1 Jun. 13, 2024

Related U.S. Application Data

(60) Provisional application No. 63/386,774, filed on Dec. 9, 2022.

(51) Int. Cl.
*E04H 4/12* (2006.01)

(52) U.S. Cl.
CPC ..... *E04H 4/1272* (2013.01)

(58) Field of Classification Search
CPC ..... E04H 4/1272; E04H 4/1236; E04H 4/14
See application file for complete search history.

(56) References Cited

U.S. PATENT DOCUMENTS 3,831,897 A * 8/1974 Stegmeier ..... E04H 4/1272 249/145
4,454,035 A * 6/1984 Stefan ..... E04H 4/1272 210/123
4,903,351 A * 2/1990 Dengel ..... E04H 4/12 4/496
4,913,810 A * 4/1990 Hodak ..... E04H 4/1272 4/496
5,604,939 A * 2/1997 Widener ..... E04H 4/1272 4/496
9,133,638 B2 * 9/2015 Hodak ..... E04H 4/1272
10,458,137 B1 * 10/2019 Hodak ..... E04H 4/1272
11,976,490 B2 * 5/2024 Owens ..... E04H 4/1272
2008/0216877 A1 * 9/2008 Lawson ..... E04H 4/1272 4/490

* cited by examiner

*Primary Examiner* — Erin Deery

(74) *Attorney, Agent, or Firm* — Richard C. Piercy, Esq.; Mathew L. Grell, Esq.; Grell & Watson Patent Attorneys LLC

(57) ABSTRACT

A pool skimmer opening cover system for prevention of intrusion of debris and liquids into the pool filtration system during installation of the pool. The system has at least a first cover and a second cover designed to be installed on the above-ground circular opening of a pool skimmer and the subterranean pool facia rectangular opening. Each cover may be installed into the corresponding location subsequent to pool skimmer installation but prior to the completion of pool construction to prevent the intrusion of debris and liquids into the systems thereof. Each cover may be removed subsequent to installation and construction of the pool to enable use of the skimmer upon such completion. A third cover to be used upon construction completion prior to filling the pool and methods of use and/or installation.

13 Claims, 6 Drawing Sheets

SYSTEM AND METHOD FOR POOL EQUIPMENT PROTECTION

CROSS REFERENCE TO RELATED APPLICATIONS

To the full extent permitted by law, the present United States Non-Provisional patent application hereby claims priority to and the full benefit of, U.S. Provisional Application No. 63/386,774, filed Dec. 9, 2022, entitled "SKIM GUARD", which is incorporated herein by reference in its entirety.

FIELD OF THE DISCLOSURE

The present invention generally relates to swimming pool skimmer installations, and, in particular, to protecting swimming pool skimmer mounting arrangements, methods for installing swimming pool skimmers, and swimming pool skimmer installation kits.

BACKGROUND OF THE DISCLOSURE

Standard swimming pool skimmers, integral to the functionality of both public and private pools, are designed to regulate debris levels and enhance overall pool cleanliness. These skimmers typically include a collection basket for debris and a return conduit connected to the pool's filtration system. Floating debris within the pool continually enters the pool filtration system via the skimmer along with surface-level water via suction of the filtration system. The basket and/or other filtration media collect various-sized debris in order to enable the easy removal of large debris, such as leaves, without needing to replace more expensive fine-filtration media and otherwise clogging pipes and networks thereof. Standard swimming pool skimmers often comprise at least two externally-facing openings. These may include a round or substantially circular opening at a ground surface and parallel therewith, similar to a manhole cover. Such a cover usually features a hole, similar to a manhole, so that a user or service technician may easily remove the top cover and each in to remove the debris and/or filtration basket. The standard swimming pool skimmers may also usually feature a throat, which is installed at a pool internal facia, which may be tiled upon completion. This throat may often be substantially rectangular and feature a flap, which may float and cause the throat to open and close during waves and/or changes in pressure/suction.

In the construction of pools having built in skimming devices, challenges arise during the construction phase, particularly in scenarios involving significant hardscaping, landscaping, and/or cement work as well as tile and other finishes that often create significant mess which may require cleaning prior to completion of the pool and at various stages thereof. Often, such standard pool skimmers are installed prior to full pool completion of the concrete installation and/or tile/finish stages of construction. This may be in order to provide a complete, finished look to the completed pool wherein the pool skimmer may be permanently installed therein finished concrete. Debris, liquids, and other unwanted materials may enter the pre-completed pool system and may therefore require significant cleaning or even replacement of the skimmer due to damages or clogged pool piping systems, which may incur significant repair costs. One means of preventing debris and other intrusions into this system is often taping and/or masking of a top opening and/or the facia opening.

Plastic sheets, cardboard, construction materials, and even scraps may be used to span these openings and tape may be applied to secure it. Such techniques may offer the benefits of preventing some or even all of such debris/material/liquid intrusion into the system and being relatively inexpensive, but have the known tradeoffs of appearing sloppy and being relatively delicate. Additionally, they may pose dangers to the homeowner or service provider(s) in that they may be tripped into and may fail through various means due to their improvised and delicate nature. Additionally, these improvised covers may not accommodate various components, which may also be used during construction and testing, such as pressure test pipes that may be installed temporarily during pool installation to confirm the skimming device's coordination with the suction and/or liquid pressure lines and piping of the larger pool filtration system. Finally, due to the nature of tape and improvised covering materials, re-application may be difficult and/or impossible and may then cause waste and/or duplicated efforts if access may be needed to the internal components of the skimming device.

Therefore, a need exists for a system and method for pool equipment protection, namely, protection of the skimming device subsequent installation of this component, but before pool completion. The instant disclosure may be designed to address at least certain aspects of the problems or needs discussed above by providing such a system and method for pool equipment protection.

SUMMARY OF THE DISCLOSURE

The disclosed system and method address at least some of the challenges associated with preventing debris and liquids from infiltrating a pool skimmer during the construction of a pool. As described above, standard skimmer assemblies are prone to contamination during construction phases, particularly when using panel-type pool constructions or undertaking significant hardscaping and finishing work. The disclosure may generally comprise a multi-cover system designed to effectively seal both the round/top and substantially rectangular/facia throated openings of the pool skimmer.

In at least one aspect of the disclosed system, it may feature a first cover for the round and/or substantially circular opening atop the pool skimmer, which may be in line with the ground or poolside surface upon pool completion. A second cover may also be included for the rectangular and/or substantially rectangular throated opening, which may be in line with the pool facia or may be recessed into a flared opening in the pool facia. These covers, may be constructed from a variety of materials, including but not limited to rigid polymeric materials, and the covers may be configured to tightly and securely, but detachably attach to the openings as may be herein described to efficiently prevent debris and liquids from entering the skimmer during construction.

In other aspects, various features enhance the system's functionality, which may be particular to the first cover. Such features may include a tall, inverted bucket construction of the circular opening cover to include a closed-end design of the first cover and handles for ease of installation and removal. It may further be so constructed at a height to accommodate a pressure check pipe, which may be further temporarily installed to ensure pressurization of various components of the pool filtration system. Further enhancements to the first cover may include various-shaped divots or openings about the perimeter of the first cover to accommodate ridges on the pool skimmer's surface.

Optional aspects of the system may include a third cover, which may be beveled at 66° in order to accommodate the flares of the constructed pool, which may be installed after concrete work has completed and the second cover is removed, or after tile work has been completed. Such bevels may in turn create a wedge therebetween the concrete/tile of the flares, further enhancing the overall system's capabilities, and such a third cover may be constructed of elastomeric material, further enhancing this wedge-like property while preventing damage to potentially finished/delicate decorative materials, such as tile and/or natural stone.

In various aspects, the disclosed method of the disclosure outlines the steps for implementing the system, to include in potentially preferred embodiments the insertion of the first and second covers to effectively seal the skimmer openings during pool construction. The method offers a practical approach to preventing debris intrusion during pool construction using the disclosed system, considering factors such as cover design, material, and the introduction of additional optional covers of the disclosed system for adaptability.

In conclusion, the system and method provide a comprehensive solution to the challenges outlined in the background, ensuring effective protection of the pool skimmer during construction and maintaining optimal functionality throughout the pool installation process.

The foregoing illustrative summary, as well as other exemplary objectives and/or advantages of the disclosure, and the manner in which the same are accomplished, are further explained within the following detailed description and its accompanying drawings.

BRIEF DESCRIPTION OF THE DRAWINGS

The present disclosure will be better understood by reading the Detailed Description with reference to the accompanying drawings, which are not necessarily drawn to scale, and in which like reference numerals denote similar structure and refer to like elements throughout, and in which.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

Figure 1:
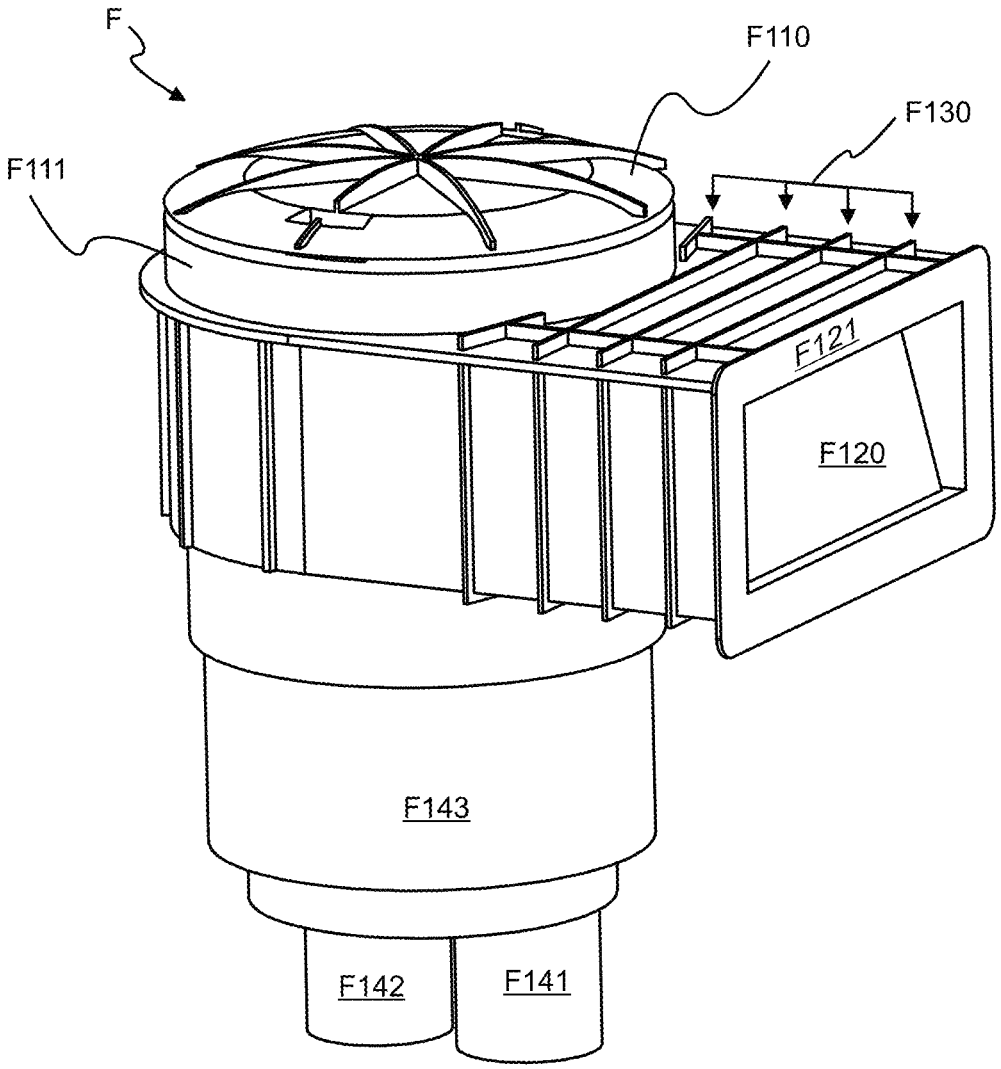
FIG. 1 is a perspective drawing of a standard pool skimming device of the disclosure.

Referring first to FIG. 1, therein is illustrated a typical swimming pool skimming device F, which may be referred to as simply skimmer F herein. As described above, skimmer F may be any standard construction of a skimmer of a pool system or pool filtration system, which may be built into the side of a pool (see FIG. 5). A throat of skimmer F may have an opening, which may be substantially rectangular as illustrated herein FIG. 1, with throat surface F121 having a flat face which may form an integral component of the installed pool wall or may be recessed when installed into a flared assembly. Through throat surface F121 may be an opening, which may open and close via weir F120 in order to provide a fluid path from the swimming pool to the well of skimmer F. Weir F120 may be pivotally mounted in the throat channel to enhance the surface skimming action and may be constructed of a material capable of floatation. One or more suction inlets F141-2 may be provided at the bottom of skimmer F which may be connected to a pump (not shown) for drawing water in through skimmer F. Skimmer F may be further equipped with various other unshown parts, such as perforated basket(s) for catching leaves and other debris. In operation, the water at the upper surface of the pool is drawn in over weir F120 and filtered through the basket. Removable lid F110, which may be substantially circular as therein illustrated, may be provided on top of skimmer F about top opening F111 in order to permit the pool owner to frequently reach in and empty the basket of the collected debris during ordinary post-installation uses of skimmer F, proximate basket area F143. Along the surface, sides, and undersides of the throat channel may exist plurality of ridges F130, which may accomplish various strength, durability, and stability features of installation therein concrete. Perhaps importantly, one or more pressure check pipes may be installed, which may connect to one of one or more suction inlets F141-2 and protrude through top opening F111 during pool construction in order to verify successful filtration performance throughout the pool installation/construction process.

Figure 2A:
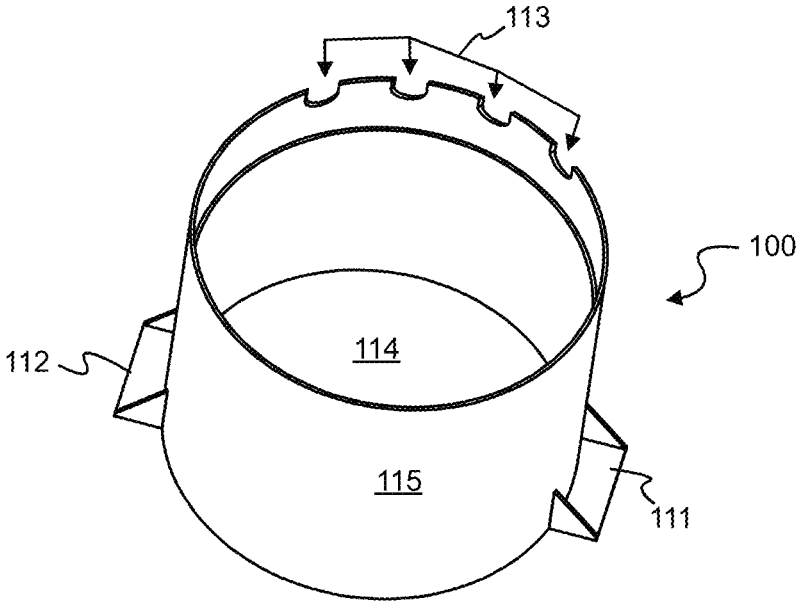
FIGS. 2A-B are perspective drawings of a first cover of the disclosure.
Figure 2B:
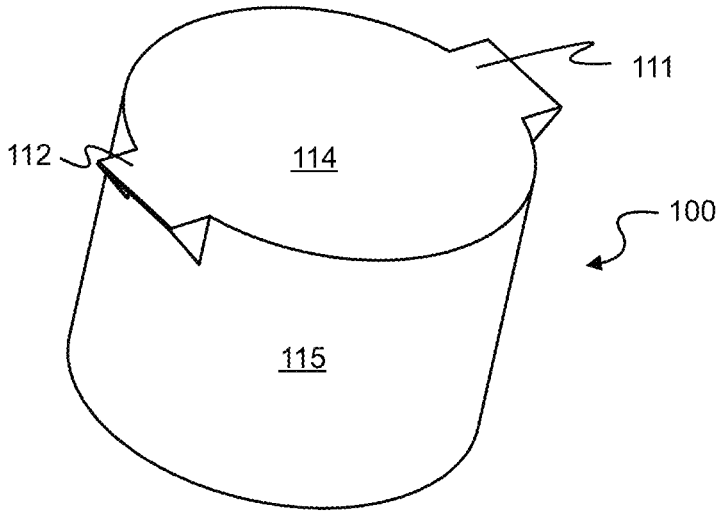

Turning now to FIG. 2A-B, therein illustrated is first cover 100 from a bottom perspective angle and a top perspective angle to better demonstrate the various features thereof. As illustrated first in FIG. 2A, first cover 100 may be formed of a single part using various plastic and/or molding techniques, including but not limited to injection molding, blow molding, extrusion molding, rotational molding, thermoforming, compression molding, the like and/or combinations thereof. Alternatively, first cover 100 may be a multi-part assembly as may be understood by those having ordinary skill in the art. First cover 100 may be generally substantially cylindrical as illustrated therein FIGS. 2A-B, as may be understood to accommodate surrounding top opening F111, and may feature an opening on its bottom side with a lip to effectuate a seal thereof. Furthermore, as may be understood by those having ordinary skill in the art, various divots and/or partial openings 113, which may be perforations, or cutouts which may exist about the perimeter of the opening of first cover 100 in order to accommodate plurality of ridges F130 of skimmer F when so installed. Top 114 of first cover 100 and cylindrical surround 115 may be solidly constructed to form the bucket-like shape, which may be inverted during use. One or more handles 111-2 may exist atop first cover 100 during construction/assembly in order to both firmly and evenly secure first cover 100 to skimmer F and in order to remove it subsequent to use as may be herein described.

Figure 3A:
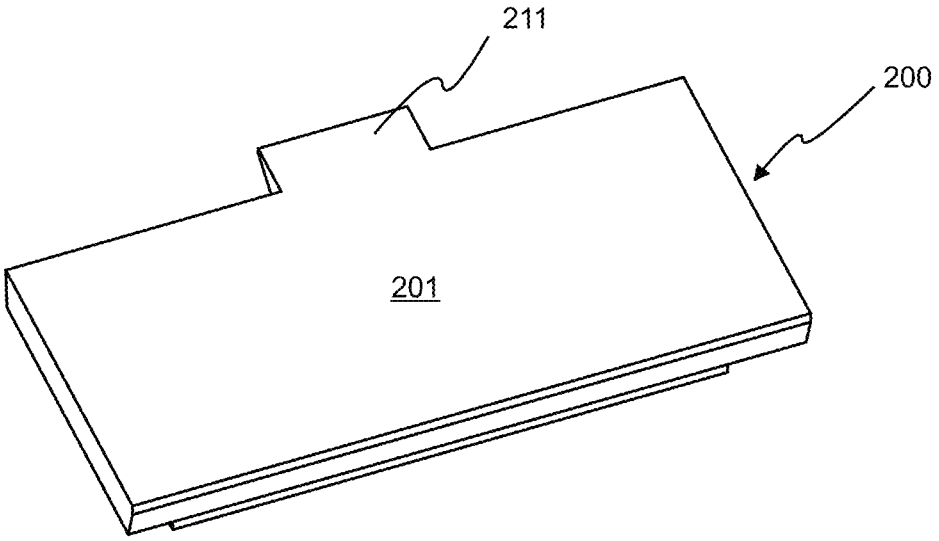
FIGS. 3A-B are perspective drawings of a second cover and an optional third cover of the disclosure.
Figure 3B:
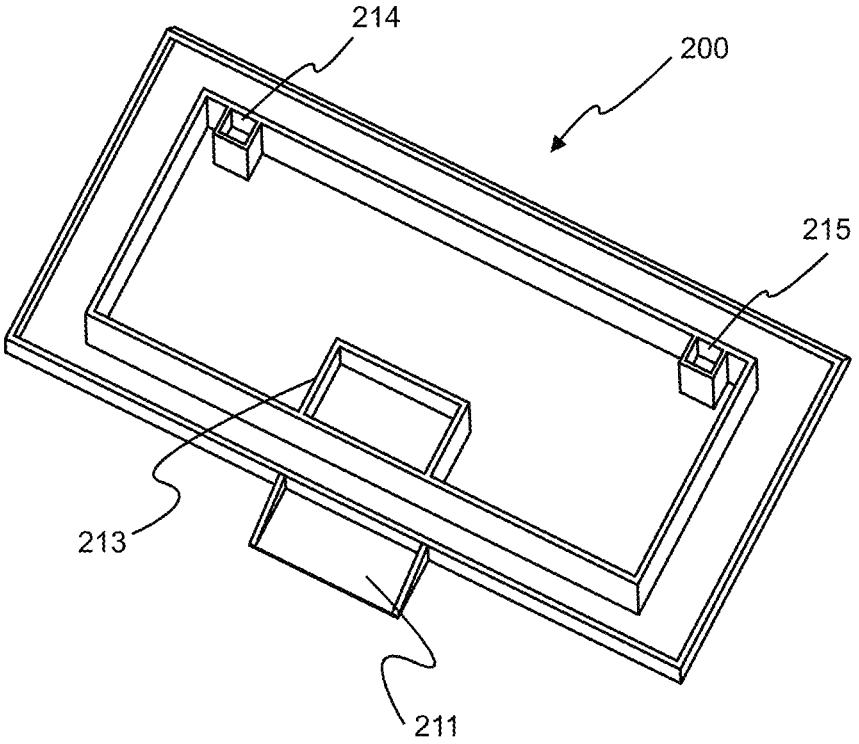

Turning to FIGS. 3A-B, therein illustrated is second cover 200, which may be similarly and/or identically constructed to an optional third cover, though materials of construction may vary. Starting at FIG. 3A, second cover may have face 201 having handle 211, which may be contoured opposite the view in FIG. 3A such that a person's fingers may assist to pry second cover from skimmer F for removal. As may be apparent in FIG. 3B, other contours and ridges may exist, such as hinge contour 213 and clip contours 214-5. Another prominent ridge may exist opposite face 201 in order for second cover 200 to fully wedge into/through throat surface F121 for secure connection thereto during pool construction as may be herein described. As may be understood by those having ordinary skill in the art, second cover 200 may be substantially rectangular in form, but may further comprise such handle 211 as a flare or other protrusion therefrom. Additionally, as may be appreciated by those having ordinary skill in the art, construction of second cover 200 may be of hard and/or rigid polymeric material, such as plastic and may be constructed using various plastic and/or molding techniques, including but not limited to injection molding, blow molding, extrusion molding, rotational molding, thermoforming, compression molding, the like and/or combinations thereof, and may be constructed of a single part or various as may be herein described. Turning to an alternate version of second cover 200, which may be used instead of, before, or subsequent use of second cover 200, various alternative materials may exist with which to provide certain elastomeric and/or rubberized properties to enable a wedge to form. A bevel about/along the edges of second cover 200, particularly along the vertical when installed portions thereof may accommodate certain tile and/or facia installations and provide protection subsequent to pool installation but prior to opening the pool for use and/or during repairs made when the pool is empty. Various features, benefits, assemblies and constructions of the system of the disclosure and methods of use thereof may be further apparent from a review of FIG. 4, showing the full assembly, and FIG. 5, showing the system in use during a particularly messy installation.

Figure 4:
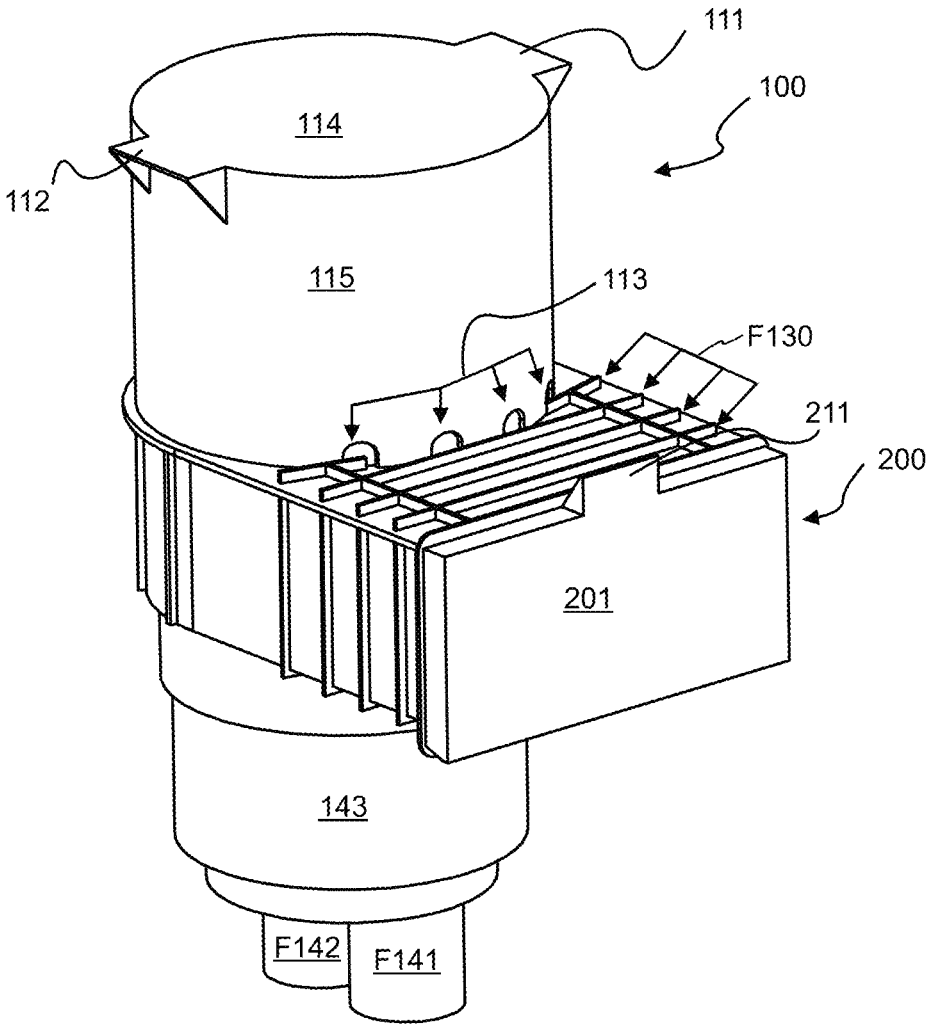
FIG. 4 is a perspective drawing of the system of the disclosure in assembly with a standard pool skimming device of the disclosure.

Turning to FIG. 4, therein illustrated is an assembly of the system of the disclosure upon one of the standard pool skimmers as illustrated as skimmer F of FIG. 1. As described above, skimmer F may be any standard construction of a skimmer of a pool system or pool filtration system, which may be built into the side of a pool (see FIG. 5). A throat of skimmer F may have an opening, which may be substantially rectangular as illustrated therein FIG. 1. Throat surface F121 as described above may have a flat face which may form an integral component of the installed pool wall or may be recessed when installed into a flared assembly. Through throat surface F121 may be an opening, which may open and close via weir F120 (see FIG. 1) in order to provide a fluid path from the swimming pool to the well of skimmer F. One or more suction inlets F141-2 may be provided at the bottom of skimmer F which may be connected to a pump (not shown) for drawing water in through skimmer F. Skimmer F may be further equipped with various other unshown parts, such as perforated basket(s). Removable lid F110 (see FIG. 1), which may be substantially circular, may be provided on top of skimmer F about top opening F111, though it may be uninstalled in certain configurations of the system during a pool installation. Turning to the components of the system which do not form a part of skimmer F, namely, first cover 100 and second cover 200, therein illustrated are first cover 100 atop top opening F111 and second cover 200 secured to throat surface F121. When so formed, various debris, liquids, and other materials that may be incidentally, accidentally, or otherwise deposited into such openings may be obstructed, thereby keeping them free of obstruction and clean until removed. Once such a pool is constructed and/or open for use, first cover 100, second cover 200, and/or third cover may be recycled, reused, stored, or otherwise disposed such that the openings of skimmer F may operate according to normal functioning and without necessitating significant cleaning and/or use of improvised covering materials, as may be further evident from a review of FIG. 5 by one having ordinary skill in the art.

Figure 5:
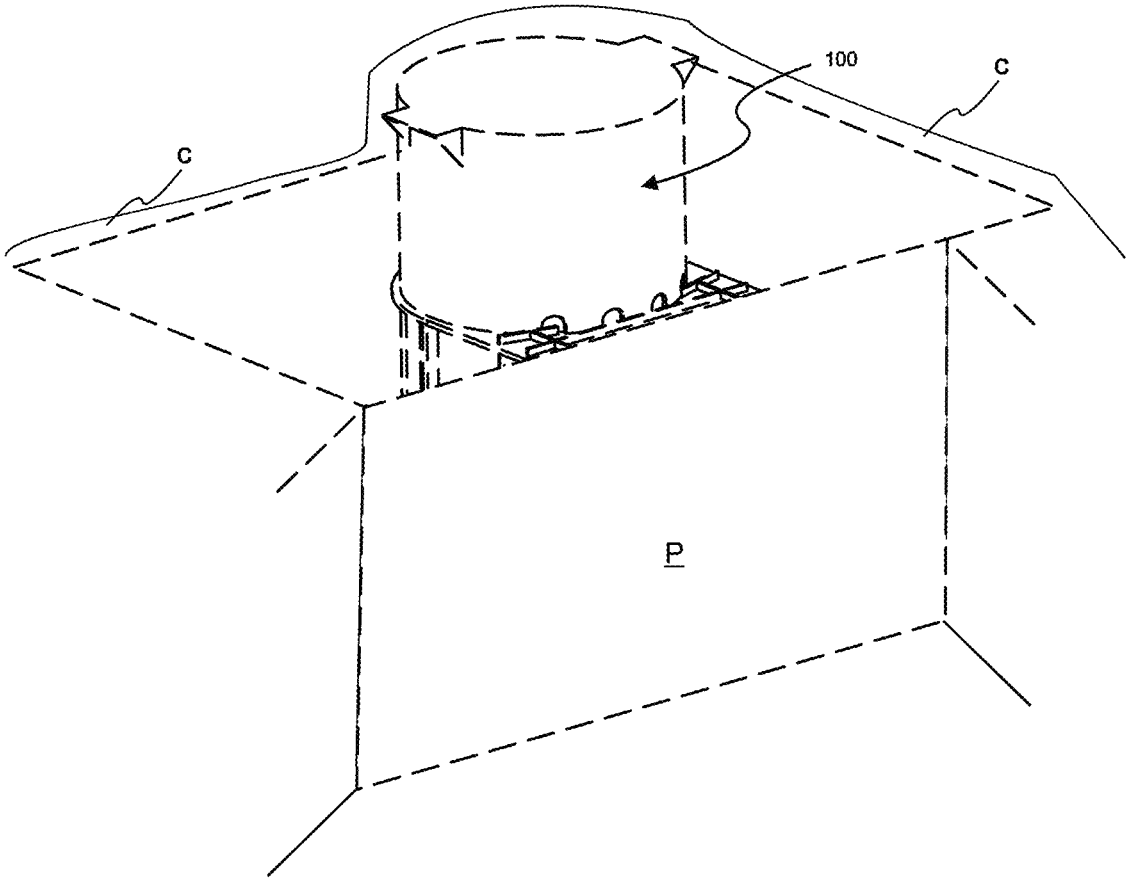
FIG. 5 is a perspective drawing of an in-progress pool installation having installed therein a system of the disclosure according to its method.

Turning now to FIG. 5, therein illustrated is a mid-construction and/or mid-repair pool P having therein installed skimmer F having first cover 100 and second cover 200 installed thereon, though obstructed by building debris C. Pool P is show having 66° flares about the left and right of throat surface F121. As may be appreciated by those having ordinary skill in the art, building debris C may be comfortably and confidently allowed to cake upon the system of the disclosure, including first cover 100 and second cover 200 (and/or third cover—not shown), without fear of damage or filth affecting the future performance of skimmer F.

Figure 6:
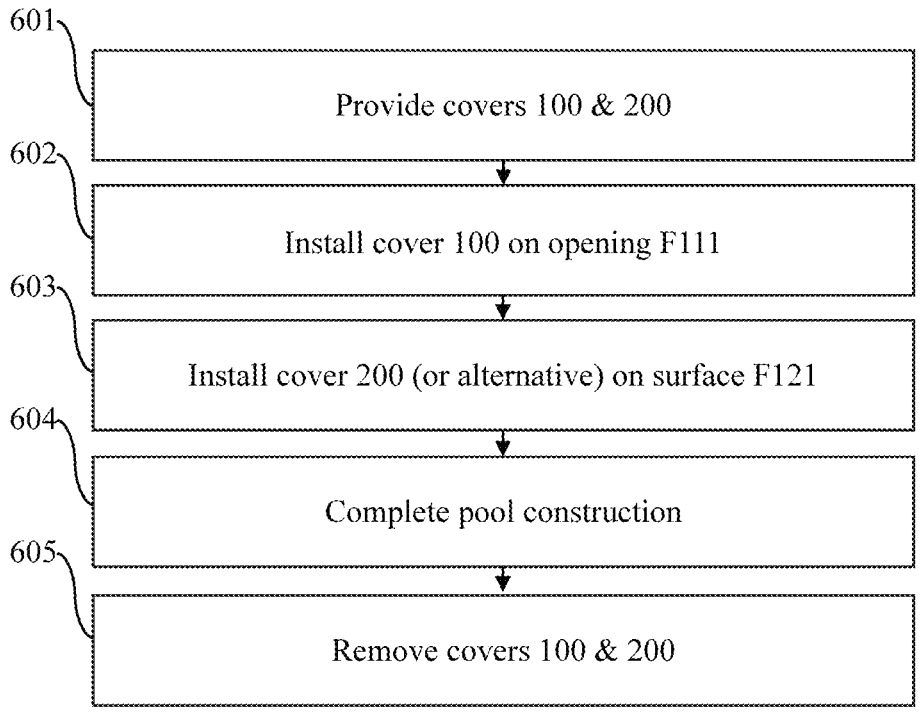
FIG. 6 is a flow chart of the method of the disclosure.

Turning now to FIG. 6, therein illustrated is a flow chart of a method of the disclosure. First at step 601, the system of the disclosure, which may include first cover 100, second cover 200 and/or third cover, may be provided. The method may be primarily for preventing intrusion of debris and a plurality of liquids into pool skimmer F during the construction of pool P, wherein the pool comprises a subterranean area (beneath the ground to be filled with water), and pool skimmer F may include a corresponding subterranean portion with a substantially rectangular throated opening in throat surface F121, which may be substantially perpendicular to the ground and an above-ground portion with a substantially round opening which may form top opening F111, which may be substantially parallel to the ground. Once provided, first cover 100 (step 602) and second cover 200 (or third cover, which may be beveled and made of rubber as described above) (step 603) may be secured to top opening F111 (step 602) and throat surface F121 (step 603), respectively. Then the pool construction may continue proceed at step 604 and the covers removed at step 605.

The illustrations described herein are intended to provide a general understanding of the structure of various embodiments of the disclosure. The illustrations are not intended to serve as a complete description of all of the elements and features of the apparatus, product, method of use, and/or system that utilizes the structures and/or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

As contemplated herein, systems of the disclosure may be manufactured in various shapes and sizes, according to installation and manufacturer requirements, including but not limited to shapes such as cylinders, triangular prisms, rectangular prisms, cubes, cones/funnels, the like and/or combinations thereof and all sizes by which pool skimmers may comprise. To this end, it is further contemplated that the system may be custom cut, shaped, and manufactured based upon measurements and shape of certain sized pool skimmers. By way of example and not limitation, a pool skimmer manufacturer may design and sell its skimmer in one size or many, and the devices and/or parts of the disclosure may be formed, designed, and/or shaped to encompass such variations. These hypothetical or actual pool skimmers may have an internal variations in height and diameter (or length/ width) either sized to international/industry standards or not sized to industry standards. Such a non-standard pool skimmer may require a custom-sized aspect of the disclosure so as to properly fit within the internal structure of the pool skimmer. While specific materials may be contemplated herein for the construction of the system of the disclosure, the disclosure is not so limited. One skilled in the art may know of other suitable materials for the purposes described herein and suitable materials not known at the time of the invention may be developed. Materials for the overall structure of the system of the disclosure include but are not limited to wood, plastic, rubber, metal, natural materials, synthetic materials, composites/composite materials (e.g., carbon fiber or fiberglass) the like and/or combinations thereof. The devices of the disclosure may feature openings, which may or may not have the capability of securely closing, to enable access to the skimmer without removal the system (e.g., access ports). Furthermore, the system of the disclosure may feature security devices, such as locks and/or fasteners, to prevent the tampering and/or removal of the system during use. Various manufacturing techniques may be used to bond, attach, or adhere the various components together or the system may be manufactured as a single-part. The disclosure is not limited to one method of bonding, attachment, or adherence and one skilled in the art may know a variety of suitable methods to accomplish the intended goal of securing the components of the disclosed apparatus together. A variety of known techniques may then be used to install and/or remove the system subsequent to pool construction and/or installation. These may include, but are not limited to, threading, latching, friction, sealant, bonding, locking, the like and/or combinations thereof. The system of the disclosure may be capable of re-use and/or re-furbish or may be designed for single-use during a single construction.

The foregoing description and drawings comprise illustrative embodiments of the present disclosure. Having thus described exemplary embodiments, it should be noted by those ordinarily skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments of the disclosure will come to mind to one ordinarily skilled in the art to which this disclosure pertains having the benefit of the teachings presented in the foregoing descriptions and the associated drawings. Although specific terms may be employed herein, they are used in a generic and descriptive sense only and not for purposes of limitation. Moreover, the present disclosure has been described in detail, it should be understood that various changes, substitutions and alterations can be made thereto without departing from the spirit and scope of the disclosure as defined by the appended claims. Accordingly, the present disclosure is not limited to the specific embodiments illustrated herein, but is limited only by the following claims.

The invention claimed is:

1. A system to prevent an intrusion of debris and a plurality of liquids into a pool skimmer during a construction of a pool, the pool having a subterranean area and the pool skimmer having a subterranean portion with a substantially rectangular throated opening substantially perpendicular to a ground, an above ground portion having a substantially round opening substantially parallel to the ground, and a plurality of ridges along a surface between the substantially rectangular throated opening and the substantially round opening, the system comprising:

a first cover having a top closed end having a first handle, a bottom open end having a perimeter featuring a second handle, a height and a diameter, said diameter corresponding to the substantially round opening of the pool skimmer, said first cover is configured with a plurality of openings to accommodate said plurality of ridges at said bottom open end; and a second cover having a length and width, said length and said width corresponding to the substantially rectangular throated opening of the pool skimmer;

wherein said first cover is capable of being inserted to surround the substantially round opening of the pool skimmer and said second cover is capable of being inserted to surround the substantially rectangular throated opening of the pool skimmer.

2. The system of claim 1, wherein said first cover and said second cover comprise a polymeric material.

3. The system of claim 2, wherein said polymeric material is rigid.

4. The system of claim 2, further comprising a third cover, said third cover having a second length a second width, and a pair of vertical beveled edges, said second length and said second width corresponding to the substantially rectangular throated opening of the pool skimmer wherein said third cover is capable of being inserted to surround the substantially rectangular throated opening of the pool skimmer.

5. The system of claim 4, wherein the pool is constructed with 66° flares from said substantially rectangular throated opening.

6. The system of claim 5, wherein said third cover is beveled at 66° and constructed of an elastomeric material.

7. The system of claim 1, wherein said second cover has an at least one handle proximate an edge.

8. The system of claim 1, wherein said height is at least 5 inches.

9. The system of claim 1, wherein said height accommodates a pipe length of the pool skimmer.

10. A method for preventing intrusion of debris and a plurality of liquids into a pool skimmer during the construction of a pool, wherein the pool comprises a subterranean area, and the pool skimmer includes a subterranean portion with a substantially rectangular throated opening substantially perpendicular to the ground and an above-ground portion with a substantially round opening substantially parallel to the ground and a plurality of ridges along a surface between the substantially rectangular throated opening and the substantially round opening, the method comprising:

providing a first cover having a top closed end, a bottom open end, a height and a diameter, wherein the diameter corresponds to the substantially round opening of the pool, the first cover further having a plurality of openings at the bottom open end configured to accommodate the plurality of ridges;

providing a second cover having a length and width, wherein the length and width correspond to the substantially rectangular throated opening of the pool skimmer;

inserting the first cover about and into surrounding engagement with the substantially round opening of the pool skimmer such that the plurality of openings engage the plurality of ridges to inhibit displacement of said first cover; and inserting the second cover to surround the substantially rectangular throated opening of the pool skimmer.

11. The method of claim 10, wherein said first cover and said second cover comprise a rigid polymeric material.

12. The method of claim 11, further comprising a step of providing a third cover, said third cover having a second length a second width, and a pair of vertical beveled edges, said second length and said second width corresponding to the substantially rectangular throated opening of the pool skimmer wherein said third cover is capable of being inserted to surround the substantially rectangular throated opening of the pool skimmer, said third cover comprises an elastomeric material.

13. The method of claim 12, further comprising a step of removing said second cover and installing said third cover.

* * * * *